US005114138A

United States Patent [19]

Ichinose

[11] Patent Number: 5,114,138

[45] Date of Patent: May 19, 1992

[54] METHOD AND APPARATUS FOR MULTIPLE SHEET DETECTION

[75] Inventor: Tadashi Ichinose, Ibaraki, Japan

[73] Assignee: Komori Corporation, Tokyo, Japan

[21] Appl. No.: 722,974

[22] Filed: Jun. 28, 1991

[30] Foreign Application Priority Data

Jul. 2, 1990 [JP] Japan ..... 2-172747

[51] Int. Cl.[5] ..... B65H 7/14

[52] U.S. Cl. ..... 271/263; 101/233

[58] Field of Search ..... 271/258, 259, 262, 263, 271/227; 101/217, 218, 232, 233, 234, 235

[56] References Cited

U.S. PATENT DOCUMENTS 3,875,860 4/1975 Barber ..... 271/263 X 4,420,747 12/1983 Kistner ..... 271/263 X 4,533,133 8/1985 Hams ..... 271/263 X

*Primary Examiner*—Richard A. Schacher

*Attorney, Agent, or Firm*—Blakely, Sokoloff, Taylor & Zafman

[57] ABSTRACT

According to a method and apparatus for multiple sheet detection for a sheet in a printing press capable of performing multiple sheet detection at a first feed operation timing which can stop feeding of the sheet to the printing press, a second feed operation timing immediately before the start of feeding of the sheet is determined. Multiple feed detection of the sheet again is performed at the determined second feed operation timing. A print stop control output is supplied to the printing press when multiple sheet feeding is detected at the determined second feed operation timing.

10 Claims, 2 Drawing Sheets

METHOD AND APPARATUS FOR MULTIPLE SHEET DETECTION

BACKGROUND OF THE INVENTION

The present invention relates to a method and apparatus for multiple sheet detection of sheets to be fed to a sheet-fed press.

A multiple sheet detection apparatus is used to perform multiple sheet detection when sheets (paper) are supplied to a conventional sheet-fed press.

More specifically, when a sheet is to be supplied from a sheet feeder to a sheet-fed press (to be referred to as a printing press hereinafter), a leading edge of a sheet is brought into contact with a stopper called a front gauge arranged at the press-side distal end portion of a feeder board, and then the sheet is gripped by a swing gripper and fed to the printing press. In this case, a multiple sheet detection apparatus is used to prevent simultaneously feeding of two or more sheets. More specifically, when two or more sheets are simultaneously fed to a printing press, a printing pressure is increased, a plate cylinder and a blanket wound around a blanket cylinder in the printing press may be deformed, and the respective cylinders may be damaged. In order to prevent this, multiple sheet detection of sheets is performed at a predetermined feed operation timing (to be described later) prior to the start of sheet feeding. When simultaneous feeding of two or more sheets is detected, the sheet feeder is stopped, and feeding of sheets to the printing press is stopped.

Conventional multiple sheet detection apparatuses are exemplified by contact (thickness detection by means of a roller), light-transmitting, ultrasonic, capacitance type multiple sheet detection apparatuses. These multiple sheet detection apparatuses are arranged in the paper feed units (or register portions) in front of the printing presses, and multiple sheet detection is performed at the predetermined feed operation timings.

For example, in the light-transmitting type multiple sheet detection apparatus, a light-emitting element is arranged on the lower surface of the feeder board near the front gauge, a through hole is formed at a predetermined portion of the feeder board opposite to a light-emitting portion of the light-emitting element, and a light-receiving element is arranged on the upper surface of the feed board at a position opposite to this through hole. More specifically, light emitted from the light-emitting element is projected in a direction of thickness of a sheet to be fed, light transmitted through the sheet is received by the light-receiving element, and an output from the light-receiving element is converted into an electrical signal. An output level corresponding to a light amount represented by the electrical signal is compared with a predetermined discrimination level, thereby performing multiple sheet detection on the basis of a comparison result. The multiple sheet detection timing is generally the last timing at which a feed stop mechanism for inhibiting simultaneously feeding of two or more sheets to the printing press can be operated. More specifically, if a mechanical timing for one sheet until feeding of the next sheet is started after the present sheet is gripped by the swing gripper and is fed is assigned as 360° and a feed start timing of a sheet to the printing press is defined as 0°, the multiple sheet detection timing is set to be, e.g., 260°, i.e., a difference between the 0° timing and, for example, 100° corresponding to the operation time of the feed stop mechanism. That is, the multiple sheet detection timing is the last timing at which the start of sheet feeding can be interrupted. This multiple sheet detection timing is set as the predetermined feed operation timing.

According to this conventional detection method, although simultaneous feeding of two or more sheets detected in the range of 0° to 260° can be detected, simultaneous feeding in a subsequent range cannot be detected. Therefore, simultaneous feeding of two or more sheets in the subsequent range cannot be prevented in advance, resulting in inconvenience.

SUMMARY OF THE INVENTION

It is an object of the present invention to provide a method and apparatus for multiple sheet detection, capable of performing multiple sheet detection in a printing press so as to prevent a failure caused by multiple sheet feeding in the printing press even if the start of paper feeding cannot be interrupted.

In order to achieve the above object according to an aspect of the present invention, there is provided a method for multiple sheet detection for a sheet in a printing press capable of performing multiple sheet detection at a first feed operation timing which can stop feeding of the sheet to the printing press, comprising the step of determining a second feed operation timing immediately before the start of feeding of the sheet, the step of performing multiple feed detection of the sheet again at the determined second feed operation timing, and the step of generating a print stop control output to the printing press when multiple sheet feeding is detected at the determined second feed operation timing.

According to another aspect of the present invention, there is provided an apparatus for multiple sheet detection in a printing press, including first timing designation means for designating a first feed operation timing capable of stopping the start of feeding of a sheet to the printing press and multiple sheet detection means for performing multiple sheet detection of the sheet at the designated first feed operation timing, comprising second timing designation means for designating multiple sheet detection to the multiple sheet detection means at a second feed operation timing immediately before the start of feeding of the sheet, and output means for outputting a print stop control output to the printing press when multiple sheet feeding is detected in multiple sheet detection at the second feed operation timing by the multiple sheet detection means.

According to the present invention, when multiple sheet feeding occurs until sheet feeding is started after multiple sheet detection is performed at a first feed operation timing, the latter multiple sheet feeding can be detected, so that cylinders in the printing press are set in a non-engaged state.

DESCRIPTION OF THE PREFERRED EMBODIMENT

A method and apparatus for multiple sheet detection according to the present invention will be described in detail hereinafter.

Figure 1:
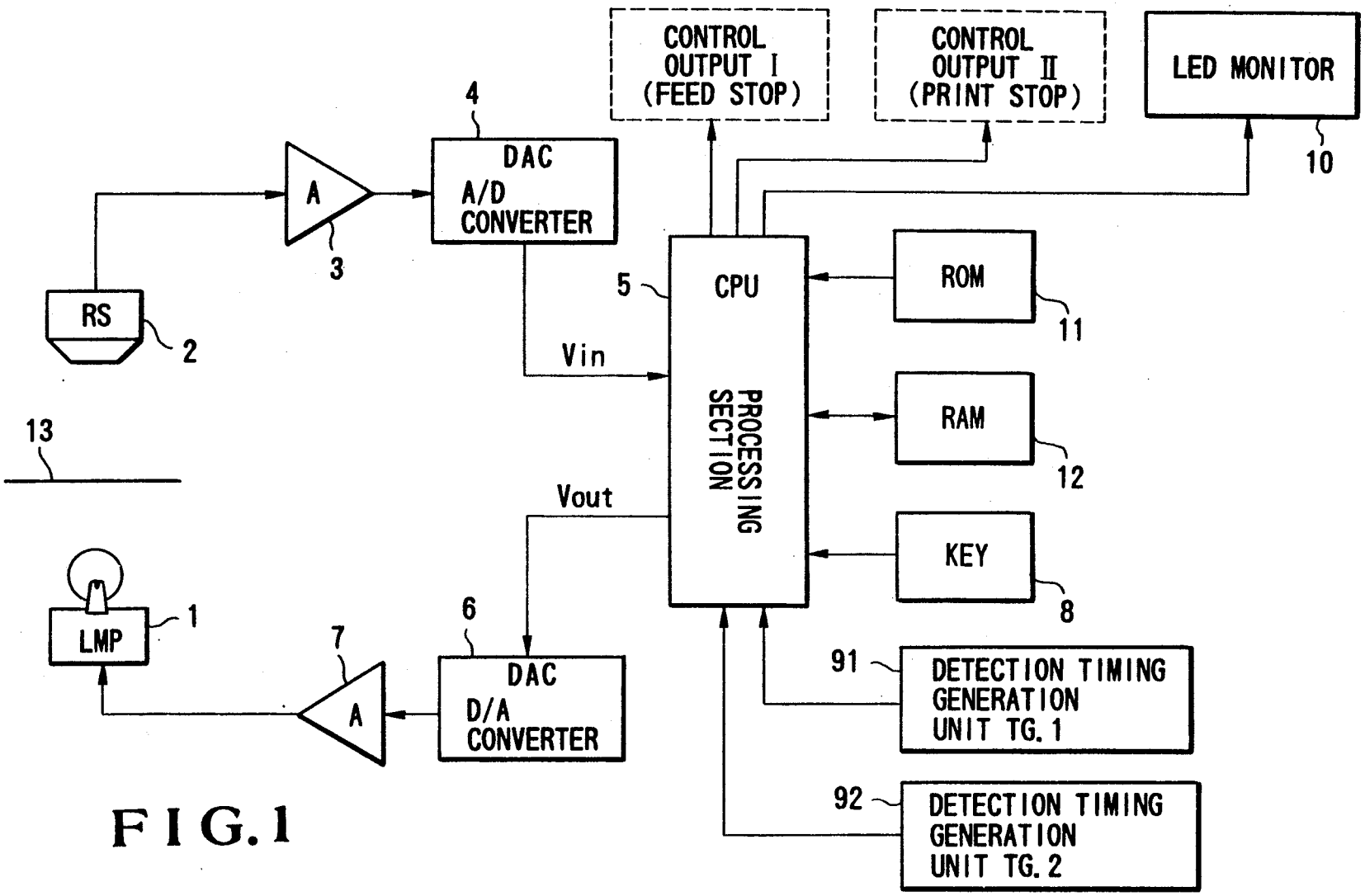
FIG. 1 is a block diagram of a system showing an apparatus which employs the present invention.

FIG. 1 shows a system configuration of the apparatus which employs the present invention. Referring to FIG. 1, reference numeral 1 denotes a light-emitting element; 2, a light-receiving element; 3, an amplifier for amplifying an output electrical signal (analog signal) corresponding to a reception light amount output from the light-receiving element 2; 4, an A/D converter for converting the amplified electrical signal supplied through the amplifier 3 into a digital signal and for outputting the digital signal to a microprocessor (to be referred to as a CPU) 5 as an output level $V_{in}$; 6, a D/A converter for converting a control level (digital signal) $V_{out}$ output from the CPU 5 into an analog signal; and 7, an amplifier for amplifying the analog signal output from the D/A converter 6 into a power signal and for supplying the power signal to the light-emitting element 1.

The CPU 5 is connected to keys 8 with which an operator inputs commands, a fist detection timing generation unit 91 for generating a first multiple feed detection timing signal for a sheet to be fed, a second detection timing generation unit 92 for generating a second multiple feed detection timing signal for the sheet, and a monitor 10 for informing the operator of processing information of the CPU 5. The central processing section is constituted by the CPU 5, a ROM 11 for storing programs for operating the CPU 5, and a RAM 12 for storing and editing various data.

The light-emitting element 1 and the light-receiving element 2 are located at the front gauge of the feeder board of a printing press (not shown) to interpose a sheet 13 therebetween, as described in the prior art. The first multiple sheet detection timing signal generated by the detection timing generation unit 91 represents the mechanical timing of 260° as the first feed operation timing described with reference to the "Prior Art". The second multiple sheet detection timing signal generated by the second detection timing generation unit 92 represents the mechanical timing of 0° as the second feed operation timing, i.e., the timing immediately before the start of paper feeding.

Figure 2:
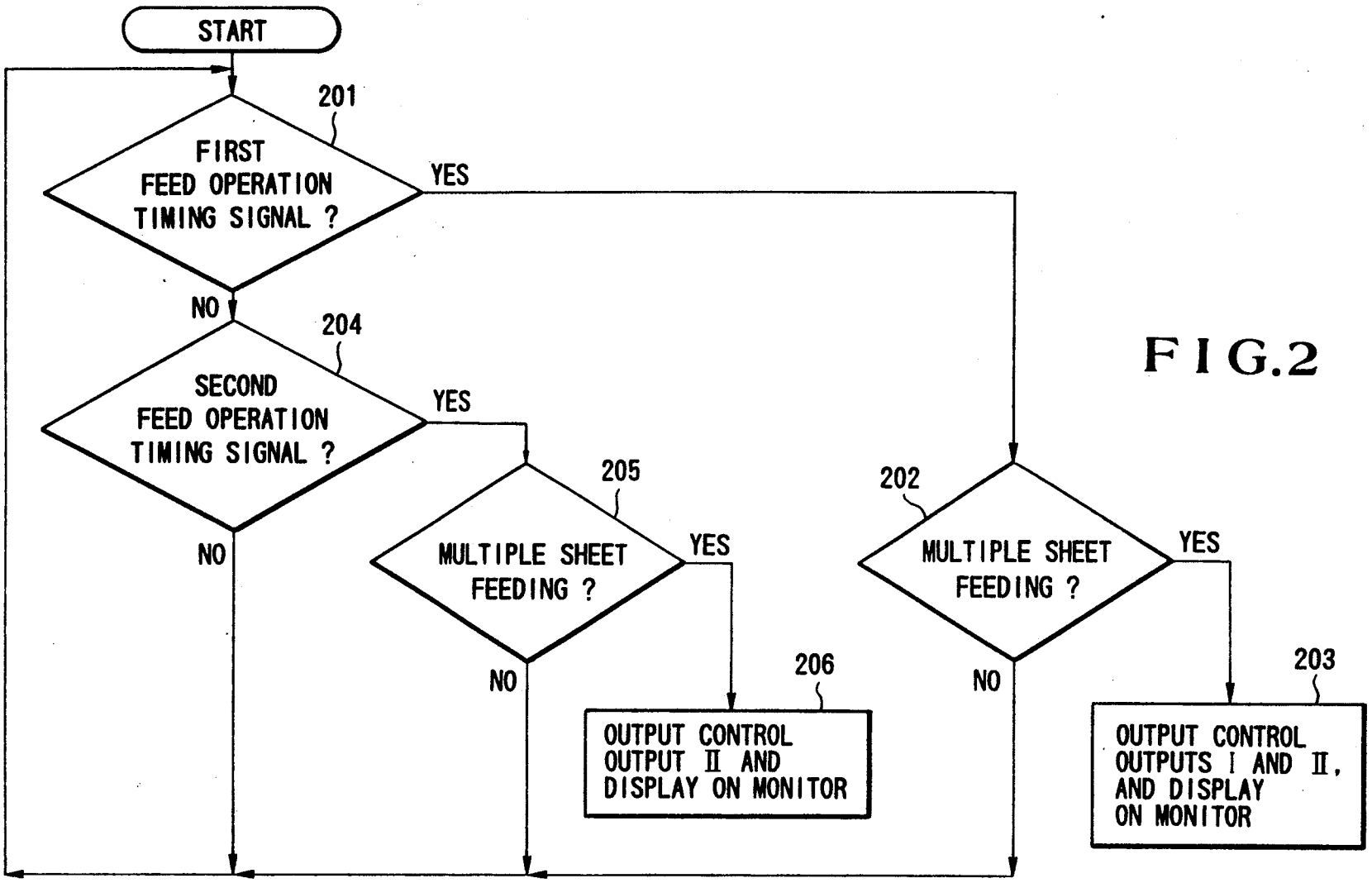
FIG. 2 is a flow chart for explaining an operation of the apparatus shown in FIG. 1.

An operation of the apparatus having the above arrangement will be described with reference to a flow chart in FIG. 2.

In multiple sheet detection of the sheet 13, the control level $V_{out}$ is supplied from the CPU 5 to the D/A converter 6, and an analog signal as a converted output from the D/A converter 6 is amplified by the amplifier 7. The amplified signal is supplied to the light-emitting element 1, so that the light-emitting element 1 is kept on in an optimal light emission amount. Light emitted from the light-emitting element 1 passes through the sheet 13. Light transmitted through the sheet 13 is received by the light-receiving element 2.

When the first multiple sheet detection timing signal is supplied from the first detection timing generation unit 91 to the CPU 5, the CPU 5 determines that this signal represents the first feed operation timing (step 201), and the flow advances to step 202. In step 202, the CPU 5 compares the output level $V_{in}$ corresponding to the light reception amount of the light-receiving element 2 with a predetermined determination level. Multiple sheet detection for the sheets 13 is performed on the basis of the comparison result. When multiple sheet feeding of the sheets 13 is detected in step 202, the flow advances to step 203. The multiple sheet feeding is informed on the monitor 10. At the same time, a control output I is output to stop sheet feeding, and a control output II is also output to stop printing. The stop of paper feeding includes the stop of sheet feeding to the printing press. A feed stop command is output at the first feed operation timing, i.e., the mechanical timing of 260°. The operation of the feed stop mechanism is effected, and the start of feeding of the sheets 13 in an overlapped state to the printing press is interrupted.

If NO in step 202, i.e., when multiple sheet feeding of the sheets 13 is not detected in step 202, however, the flow returns to step 201. When a predetermined period of time has elapsed after the detection timing generation unit 91 generates the first multiple sheet feed detection timing signal, the detection timing generation unit 92 generates the second multiple sheet detection timing signal. When this signal is supplied from the detection timing generation unit 92 to the CPU 5, the CPU 5 detects this signal as the second feed operation timing (step 204), and the flow advances to step 205. In step 205, the CPU 5 compares the output level $V_{in}$ corresponding to the light reception amount of the light-receiving element 2 with the predetermined determination level. Multiple sheet detection of the sheets 13 is performed on the basis of the comparison result. In step 205, when multiple paper feeding of the sheets 13 is detected, the flow advances to step 206, and this is informed on the monitor 10. At the same time, the control output II is generated to stop printing. In this case, the stop of printing includes disengagement of cylinders. A cylinder disengagement command is output at the second feed operation timing, i.e., immediately before the mechanical timing of 0°. In this case, feeding of the sheets 13 in the overlapped state to the printing press is performed. However, since the cylinders are disengaged from each other in the printing press, i.e., a safe state free from a pressurized state is obtained. The sheets 13 in the overlapped state are directly discharged, and damage to the printing press can be prevented.

In this embodiment, the first convey operation timing is defined as the mechanical timing of 260°. However, the first convey operation timing may be any mechanical timing of smaller than 260°. That is, if the first feed operation timing can prevent the start of feeding of the sheet 13, it need not be the final timing.

As can be apparent from the above description, according to the present invention, when multiple sheet feeding occurs immediately before the start of feeding of the sheet upon multiple sheet detection at the first feed operation timing, the latter multiple sheet feeding can be detected.

In this case, feeding of the sheets is not stopped at the second feed operation timing, the cylinders in the printing press are disengaged from each and damage to the printing press can be prevented.

What is claimed is:

1. A method for multiple sheet detection for a sheet in a printing press capable of performing multiple sheet detection at a first feed operation timing which can stop feeding of the sheet to said printing press, comprising:

the step of determining a second feed operation timing immediately before the start of feeding of the sheet;

the step of performing multiple feed detection of the sheet again at the determined second feed operation timing; and the step of generating a print stop control output to said printing press when multiple sheet feeding is detected at the determined second feed operation timing.

2. A method according to claim 1, wherein the step of generating the print stop control output comprises the step of generating a cylinder disengagement command to said printing press.

3. A method according to claim 1, wherein the step of generating the print stop control output comprises the step of performing alarming or display to an operator.

4. A method according to claim 1, further including the step of outputting a feed stop control output and the print stop control output to said printing press when the multiple sheet feeding is detected at the first feed operation timing.

5. An apparatus for multiple sheet detection in a printing press, including first timing designation means for designating a first feed operation timing capable of stopping the start of feeding of a sheet to said printing press and multiple sheet detection means for performing multiple sheet detection of the sheet at the designated first feed operation timing, comprising:

second timing designation means for designating multiple sheet detection to said multiple sheet detection means at a second feed operation timing immediately before the start of feeding of the sheet; and output means for outputting a print stop control output to said printing press when multiple sheet feeding is detected in multiple sheet detection at the second feed operation timing by said multiple sheet detection means.

6. An apparatus according to claim 5, wherein said output means outputs a cylinder disengagement command to said printing press.

7. An apparatus according to claim 5, further comprising alarm means for performing alarming or display to an operator in accordance with an output from said output means when the print stop control output is supplied to said printing press.

8. An apparatus according to claim 5, wherein said output means includes means for outputting a feed stop control output and the print stop control output to said printing press when the multiple sheet feeding is detected at the first feed operation timing.

9. An apparatus according to claim 5, wherein said first designation means designates the first feed operation timing within a period corresponding to 260° in a cycle of 360° for starting feeding of the next sheet after the start of feeding of the sheet.

10. An apparatus according to claim 5, further comprising a pair of light-emitting and light-receiving elements opposite to each other so as to interpose the sheet therebetween, said pair of light-emitting and light-receiving elements being arranged at a front gauge of a feeder board, and wherein said multiple sheet detection means performs multiple sheet detection on the basis of an output from said light-receiving element.

* * * * *

UNITED STATES PATENT AND TRADEMARK OFFICE

CERTIFICATE OF CORRECTION

PATENT NO. : 5,114,138

DATED : May 19, 1992

INVENTOR(S) : Tadashi Ichinose

It is certified that error appears in the above-identified patent and that said Letters Patent is hereby corrected as shown below:

Col. 4, line 52, insert --other, the overlapping sheets are directly discharged,-- before "and damage".

Signed and Sealed this

Fourth Day of July, 1995

Bruce Lehman

*Attest:*

BRUCE LEHMAN

*Attesting Officer*

*Commissioner of Patents and Trademarks*